US006202881B1

(12) United States Patent
Chiang

(10) Patent No.: US 6,202,881 B1
(45) Date of Patent: Mar. 20, 2001

(54) BEVERAGE CONTAINER WITH EASY CLEANING UPPER PANEL

(76) Inventor: Charles N. Chiang, 520 Kingsford St., Monterey Park, CA (US) 91754

( * ) Notice: Subject to any disclaimer, the term of this patent is extended or adjusted under 35 U.S.C. 154(b) by 0 days.

(21) Appl. No.: 09/624,357

(22) Filed: Jul. 24, 2000

Related U.S. Application Data

(63) Continuation of application No. 09/177,237, filed on Oct. 22, 1998.

(51) Int. Cl.[7] ..... B65D 17/34

(52) U.S. Cl. ..... 220/269; 220/906; 220/257; 206/508

(58) Field of Search ..... 220/269, 270, 220/906, 257, 604, 606–607, 619, 620, 672, 656–659; 206/508

(56) References Cited

U.S. PATENT DOCUMENTS 4,480,763 * 11/1984 Schneider ..... 220/269
4,913,305 * 4/1990 Hanafusa et al. ..... 220/269
5,555,993 * 9/1996 Borkowski et al. ..... 220/906 X
5,647,497 * 7/1997 Labbe ..... 220/269 X
5,655,678 * 8/1997 Kobayashi ..... 220/906 X
5,749,488 * 5/1998 Bagwell et al. ..... 220/906 X

FOREIGN PATENT DOCUMENTS 1-39936 * 8/1989 (JP) .
3-14455 * 1/1991 (JP) .
4-311452 * 11/1992 (JP) .
9-193930 * 7/1997 (JP) .

* cited by examiner

*Primary Examiner*—Nathan J. Newhouse
(74) *Attorney, Agent, or Firm*—Raymond Y. Chan; David and Raymond Patent Group

(57) ABSTRACT

A beverage container includes an easy cleaning upper panel which has a flat opening portion and a lifting portion, wherein the flat opening portion can prevent the dirt from accumulating in the ring shaped indented groove formed around the upper panel of the conventional beverage container. Besides, an enlarged gap is sufficiently provided between a lifting portion on the upper panel and the lifting ring, so that the consumer can easily grip on the lifting ring. Moreover, a protective film is detachably attached on the upper panel so that the consumer may simply remove the protective film to obtain a clean panel surface for consuming the beverage.

17 Claims, 6 Drawing Sheets

BEVERAGE CONTAINER WITH EASY CLEANING UPPER PANEL

CROSS REFERENCE OF RELATED APPLICATION

This is a continuation application of a previous non-provisional application, application Ser. No. 09/177,237, filed on Oct. 22, 1998.

FIELD OF THE PRESENT INVENTION

The present invention relates to beverage containers, and more particularly to a beverage container with easy cleaning upper panel that can prevent the dirt from accumulating in the ring shaped indented groove formed around the upper panel thereof, where the user would find very difficult to clean out the accumulated dirt and will also drink the dirt while consuming the containing beverage.

BACKGROUND OF THE PRESENT INVENTION

FIG. 1 shows a common beverage container structure, which is generally illustrated in U.S. Pat. Nos. 5,645,189, 5,590,807, 4,606,472, 4,578,007, or 3,774,801. The conventional beverage container 10 comprises a U-shape can body 11, an upper panel 12 sealedly connected to a top end of the U-shape can body 11, and an opening device 13 for opening an opening portion of the upper panel. The opening device 13 is formed of a lifting ring 131, a pressing portion 132 integrally formed with the lifting ring, an elongated portion 133 extending from the lifting ring, and a fixing member 134 affixing a part of the elongated portion 133 to the upper panel 12. Since the fixing member 134 must be affixed to a central flat surface 121 of the upper panel 12, a round shaped indented groove 122 having a predetermined depth has to provided around the upper panel 12 to reinforce the central flat surface 121 while the pressing portion 132 is pressed down against the central flat surface 121 of the upper panel 12 by lifting up the lifting ring 131.

Undoubtfully, such indented groove 122 is a smart design to prevent the central flat surface 121 of the upper panel 12 from being bent out of shape that may make the opening of the can becoming extremely difficult. However, it merely solves the mechanical problem but, at the same time, creates an unexpected serious sanitary problem to every beverage consumer.

In fact, it takes a long time before a beverage container delivers to a consumer. After a beverage container is manufactured in the factory, it will be stored in the warehouse for days before it is ordered by a retailer. Cockroach and mice may crawl or run on the upper panel 12 and leave behind residue of germs in the indented groove 122. Therefore, during the storing period, dust, germs deposited by insects and rodents, and bacteria will start to accumulate on the upper panel 12, especially in the indented groove 122. During the delivery from the factory to the retailer, the indented groove 122 would continue to collect dirt and bacteria. Even the beverage container arrives the retailer, before the consume purchases the can of beverage from the retailer or the beverage machine, more dust, bacteria and germs would be accumulated on the upper panel 12 and in the indented groove 122. That is why almost every consumer will use tissues, handkerchiefs or at least his or her hand to wipe over the upper panel 12 attempting to remove the dirt thereon before consumption so as to avoid consuming the dirt and germs too.

However, most people including the beverage container manufacturers fail to aware that no matter how to clean the upper panel 12, the dirt collected in the indented groove 122 is still hiding therein. It is nearly impossible to reach the bottom of the indented groove 122 without the help of a special sharp tool. Therefore, when one is consuming the beverage inside the beverage container 10, the flowing out beverage will first flow inside the indented groove 122 and will substantially wash and dissolve the dirt inside the indented groove 122 before entering the consumer's mouth. Besides, between the first sip and the last sip, dirt will be dissolved by the residual beverage left in the indented groove 122. Subsequently, it will be all drunk off by the consumer. Even the consumers refuse to directly consume the beverage with mouth. The flowing out beverage will still wash the indented groove 122 and the beverage will be poured with the dirt and germs into the cup. Therefore, the beverage container consumer would virtually drink the beverage as well as the dirt, bacteria and germs.

Moreover, the lifting ring 131 is normally extended on the central flat surface 121 of the upper panel 12. Only a very narrow gap 15 is provided between the lifting ring 131 and the central flat surface 121 of the upper panel 12 for the consumer's finger to lift and grip the lifting ring 131. May be the designer of the beverage container is not a female, so that he did not aware that most girls and ladies pay great care to their finger nails. No one likes to take the risk of breaking her beautiful nail by using her nail tip to lift and grip the lifting ring 131.

SUMMARY OF THE PRESENT INVENTION

It is thus a first object of the present invention to provide a beverage container with easy cleaning upper panel that can prevent the dirt from accumulating in the ring shaped indented groove formed around the upper panel of the conventional beverage container.

A further object of the present invention is to provide a beverage container with easy cleaning upper panel wherein the conventional indented groove is eliminated while still providing a reinforced structure to incorporate with the opening device of the beverage container.

Yet another object of the present invention is to provide a beverage container with easy cleaning upper panel wherein an enlarged gap is sufficiently provide between a lifting portion on the upper panel and the lifting ring, so that the consumer can easily grip on the lifting ring.

Still another object of the present invention is to provide a beverage container with easy cleaning upper panel wherein a protective film is capable of attaching on the upper panel so that the consumer may simply remove the protective film to obtain a clean panel surface for consuming the beverage.

Accordingly, in order to accomplish the above objects, the present invention provides a beverage container which comprises a tubular can body, a concave bottom panel integrally formed at a bottom end of the can body, an upper panel integrally formed at a top end of the can body, and an opening device comprising a lifting ring, a pressing portion integrally formed with the lifting ring, an affixing portion formed between the lifting ring and the pressing portion, and a fixing member affixing the affixing portion to the upper panel. The upper panel is divided into two an opening portion and a lifting portion. The opening portion has a semi-circular flat surface extending to a first segment of peripheral edge of the upper panel. The lifting portion provides a semi-circular indented area extending from a side edge of the opening portion to a second segment of peripheral edge. The fixing member is affixed adjacent to the side edge of the opening portion, so that the lifting ring is extended above the lifting portion of the upper panel while the pressing portion is extended on the opening portion. A ring-shaped precut breaking line is formed on the opening portion, so that when the pressing portion of the opening device presses on the opening portion of the upper panel by lifting up the lifting ring, an opening will be formed along the precut breaking line for the beverage stored inside the beverage container to pour out therethrough.

DETAILED DESCRIPTION OF THE PREFERRED EMBODIMENTS

Figure 2:
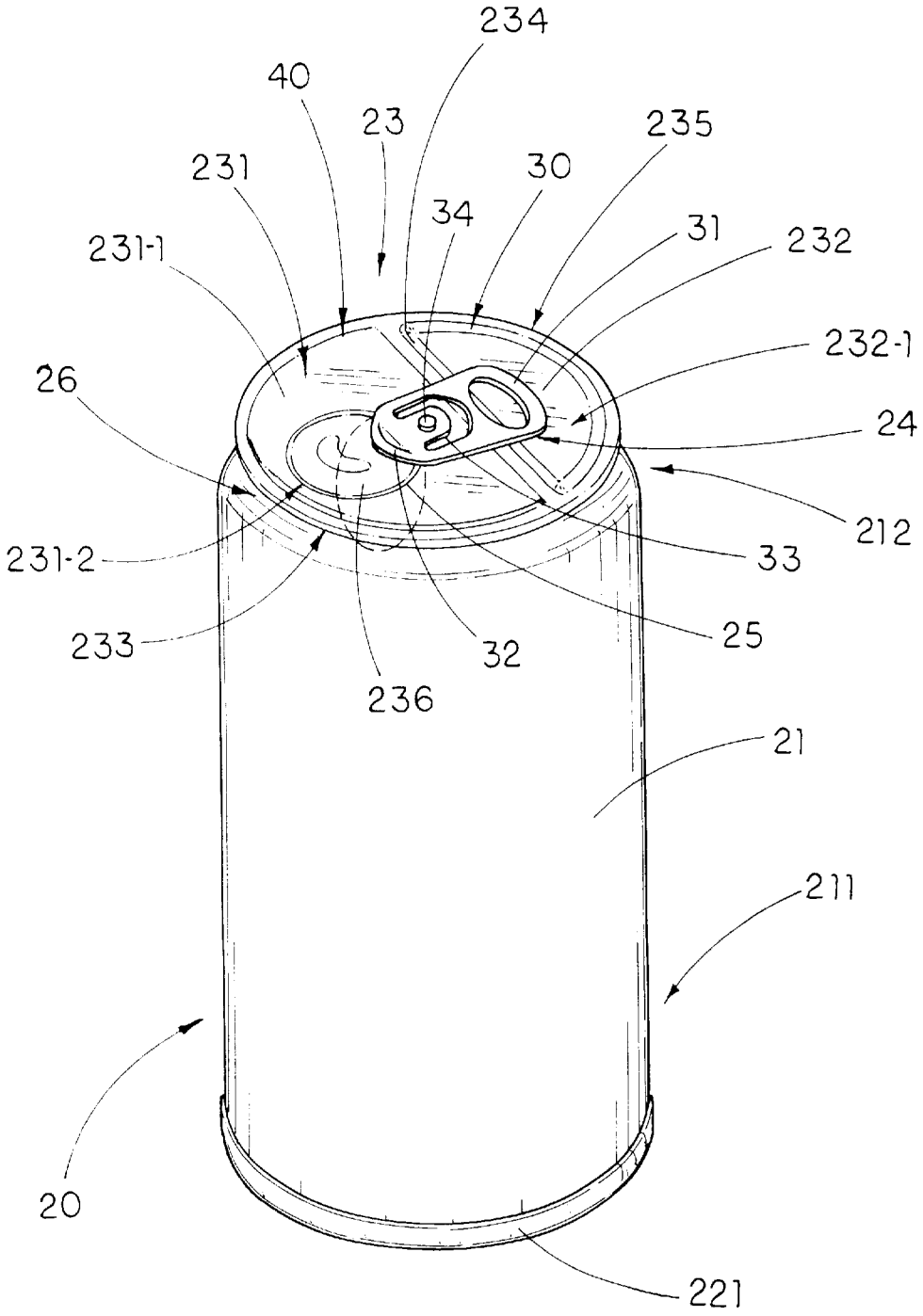
FIG. 2 is a perspective view of a beverage container according to a preferred embodiment of the present invention.
Figure 3:
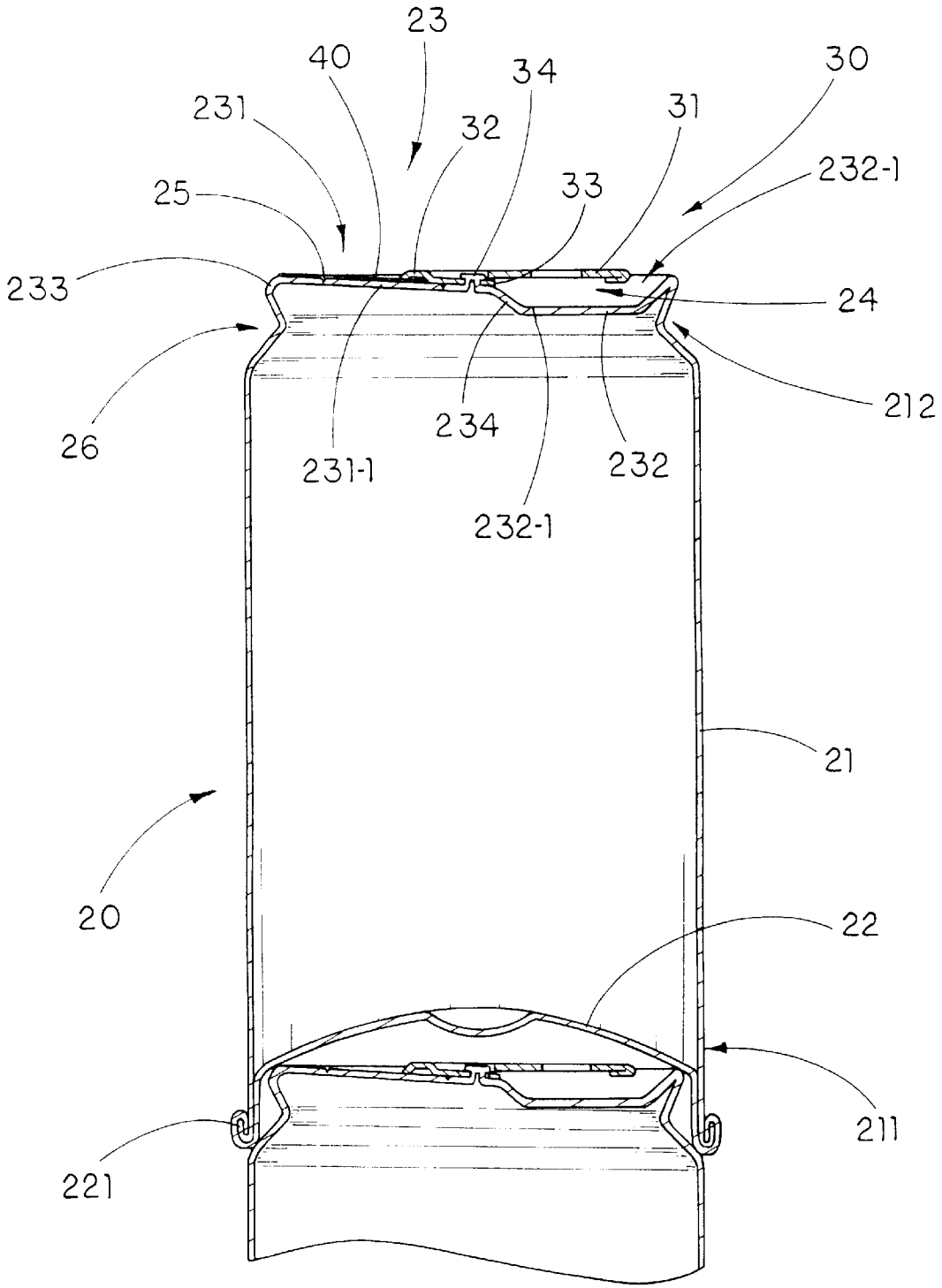
FIG. 3 is a sectional view of the beverage container stacked on top of another container according to the above preferred embodiment of the present invention.

Referring to FIGS. 2 and 3 of the drawings, a beverage container with easy cleaning upper panel according to a preferred embodiment is illustrated. The beverage container 20 comprises a tubular can body 21, a concave bottom panel 22 integrally formed at a bottom end 211 of the can body 21, an upper panel 23 integrally formed at a top end 212 of the can body 21, and an opening device 30.

The opening device 30 comprises a lifting ring 31, a pressing portion 32 integrally formed with the lifting ring 31, an affixing portion 33 formed between the lifting ring 31 and the pressing portion 32, and a fixing member 34 affixing the affixing portion 33 to the upper panel 23.

The upper panel 23 is divided into two an opening portion 231 and a lifting portion 232. The opening portion 231 has a semi-circular flat surface 231-1 extending to a first semi-circular segment of peripheral edge 233 of the upper panel 23. The lifting portion 232 provides a semi-circular indented area 232-1 extending from a side edge 234 of the opening portion 23 to a second segment of peripheral edge 235. The fixing member 34 is affixed adjacent to the side edge 234 of the opening portion 23, so that the lifting ring 31 is extended above the lifting portion 232 of the upper panel 23 while the pressing portion 32 is extended on the opening portion 231.

A gap 24 is defined between the lifting ring 31 and the bottom of the indented area of the lifting portion 232. The height of the gap 24 is generally equal to the depth of the indented area 232-1 of the lifting potion 232. A Ring-shaped precut breaking line 25 is formed on the opening portion 231, wherein when the pressing portion 32 of the opening device 30 presses on the opening portion 231 of the upper panel 23 by lifting up the lifting ring 31, an opening 231-2 will be formed along the precut breaking line 25 for the beverage stored inside the beverage container 20 to pour out therethrough.

In FIGS. 2 and 3, it is shown that the peripheral edge is divided into two halves, i.e. the first segment of peripheral edge 233 and the second segment of peripheral edge 235. The flat surface 231-1 of the opening portion 231 is preferable flatly extended within a boundary defined by the first segment of peripheral edge 233 and the side edge 234. The precut breaking line 25 is formed on that flat surface 231-1 of the opening portion 231 and defines a valve member 236 as shown in FIG. 2. Therefore, when the pressing portion 32 presses against the valve member 236 downwardly, the precut breaking line 25 will break and force the valve member 236 to move downwards to form an opening 231-2. The beverage containing in the beverage container 20 of the present invention can thus pour out through the opening 231-2. Since there is no indented groove formed on the flat surface 231-1 of the opening portion 231, no dirt will be accumulated in such unreachable groove of the conventional beverage container. The consumer can easily wipe over to clean the flat surface 231-1 of the opening portion 231 before consuming the beverage. The greatest shortcoming of the conventional beverage container can thus be eliminated.

Moreover, since the lifting portion 232 is arranged lower than flat surface 231-1 of the opening portion 231 to define the indented area 232-1 above, the side edge 234 and the second segment of peripheral edge 235 form a semi-circular rim surrounding the indented area 232-1, that not only defines the gap 24 facilitating the consumer's finger to insert and grip the lifting ring 31, but also reinforces the upper panel 23 to prevent deformation by unexpected impact or pressure.

According to the preferred embodiment shown in FIGS. 2 and 3, both the side edge 234 of the opening portion 231 and the second segment of peripheral edge 235 are inclinedly extended to the lifting portion 232, wherein the side edge 234 substantially reinforces the affixing portion 33 of the opening device to prevent deformation of the opening portion 231 while lifting the lifting ring 31 to press down the pressing portion 32 of the opening device 30.

In order to further reinforce the upper panel 23, a ring groove 26 is preferably formed around the top end of the can body 21 right below the peripheral edge of the upper panel 23. As shown in FIG. 3, the ring groove 26 with respect to the opening portion 231 of the upper panel 23 renders the first segment of peripheral edge 233 to have a V-shape cross section that can substantially strengthen and reinforce the opening portion 231. Furthermore, with respect to the ring groove, the second segment of peripheral edge 235 forms an overlapped rim that greatly increases the rigidity of the upper panel 23.

Figure 1:
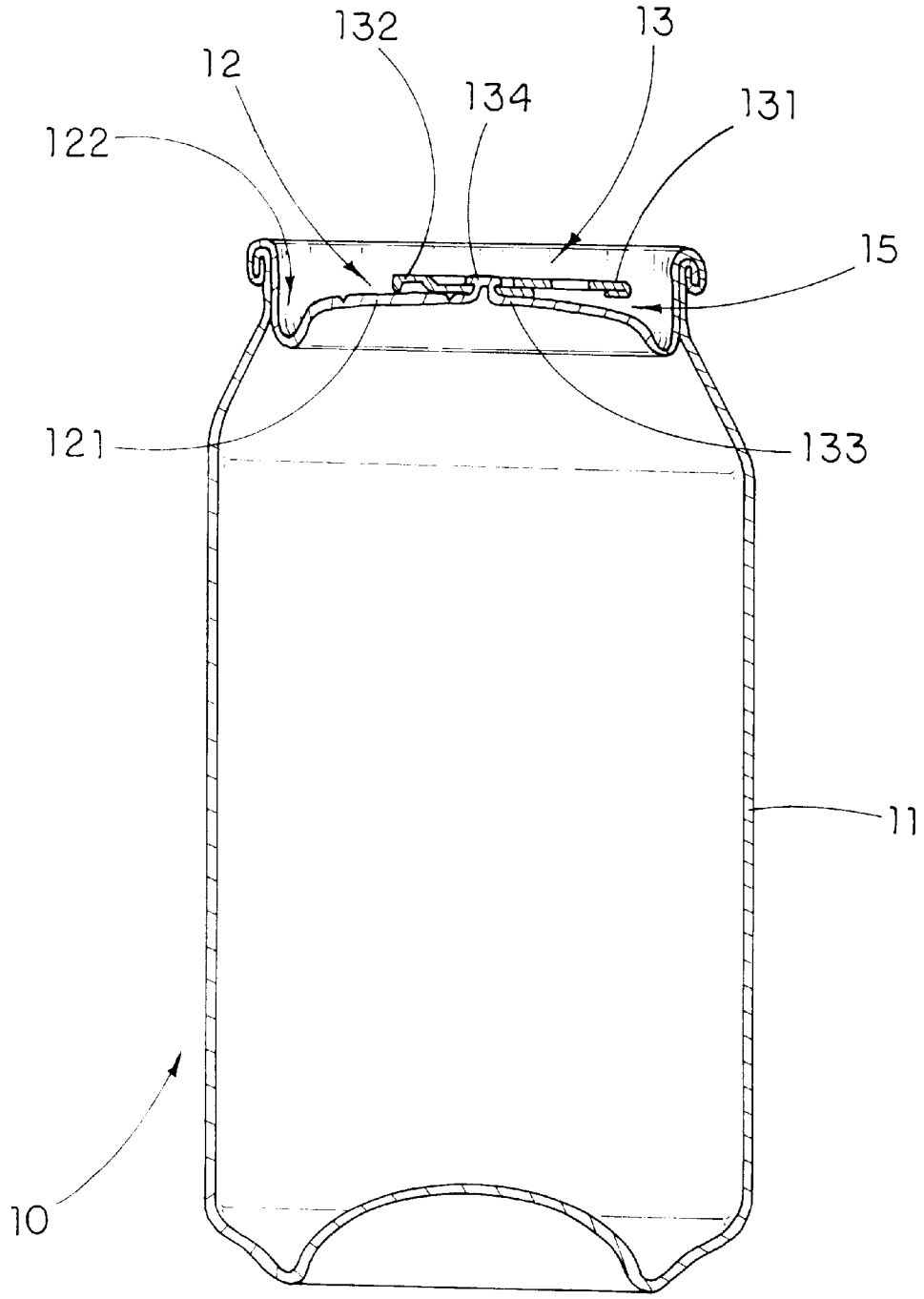
FIG. 1 PRIOR ART
FIG. 1 is a sectional view of a conventional beverage container.

As shown in FIG. 1, in view of the conventional beverage container 10, the can body 11 has a bottom panel and a surrounding wall integrally extended from the peripheral edge of the bottom panel upwardly. However, generally, the upper panel 12 is an independent member sealed edge to edge with the top end of the can body 11 to form a peripheral rim. However, in order to facilitate the formation of the flat surface 231-1 of the opening portion 231, it is more prefer to form the upper panel 23 from a single piece of material by press mold. Therefore, as shown in FIG. 3, the can body 21 and the upper panel 23 according to the preferred embodiment of the present invention are made from a single piece of material. On the contrary, the bottom panel 22 is formed from another piece of material and sealedly connected to the bottom end 211 of the can body 21 edge to edge to form a reinforcing peripheral rim 221.

As shown in FIG. 3, it is also preferable to made the upper panel 23 having a diameter smaller than the bottom panel 22, so that when one beverage container can be stacked on top of another one, the upper panel 23 of the lower beverage container would be covered and limited by the concave bottom panel 22 of the upper beverage container.

To further ensure the sanitary, as shown in FIGS. 2 and 3, a protective film 40 is pre-attached on the opening portion 231 of the upper panel 23 to at least cover the valve member 236. Therefore, the consumer can firstly tear off the protective film 40 before opening the beverage container so as to ensure an absolutely clean opening portion 231 for contacting with the consumer's lip. Of course, the consumer may also directly open the valve member 236 first, and then tear off the protective film 40.

According to the present invention, the sanitary while consuming the beverage container in the beverage container 20 can thus be well ensured. Moreover, the enlarged gap between the lifting ring 31 and the lifting portion 232 enables even the females to operate the opening device 30 easily without the worry of damaging their finger nails.

It is worth to mention that various apparent modifications can be made to the beverage container according to the inventive subject matters and concepts in view of the above disclosure. Some alternative modes are illustrated in FIGS. 4A, 4B and 5.

Figure 4A:
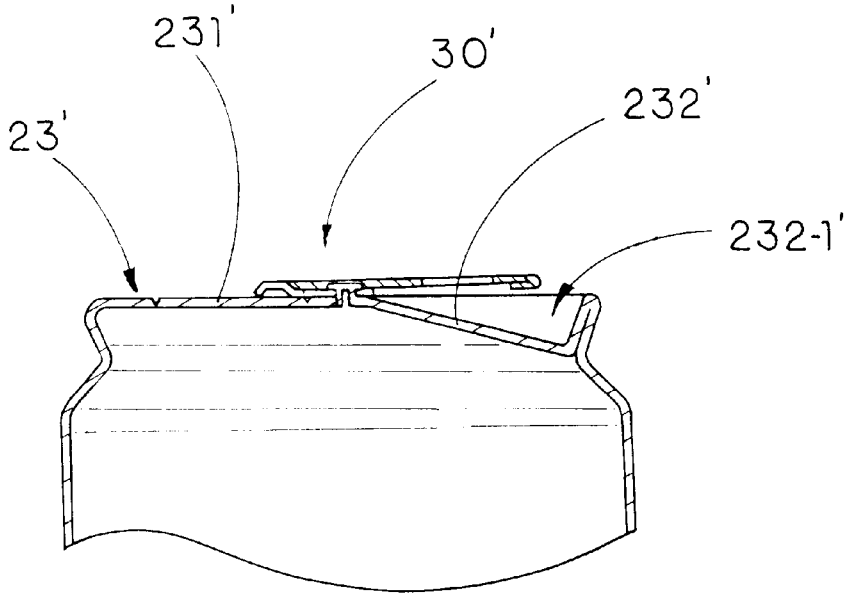
FIG. 4A is a partial sectional view of a first alternative mode of the beverage container according to the above preferred embodiment of the present invention.
Figure 4B:
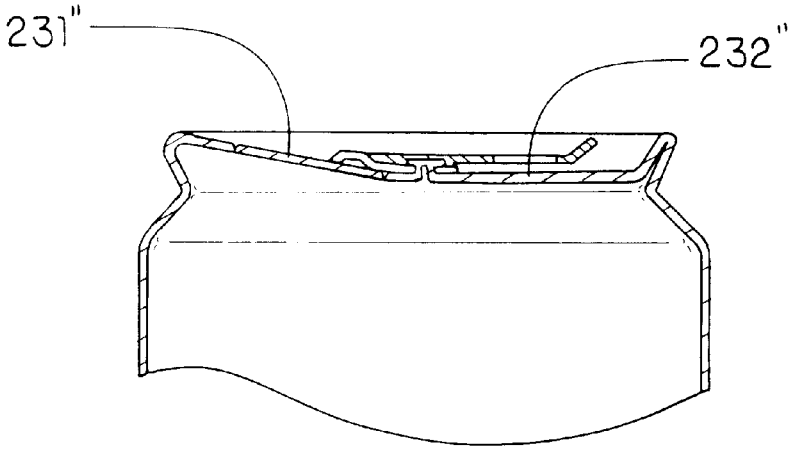
FIG. 4B is a partial sectional view of a second alternative mode of the beverage container according to the above preferred embodiment of the present invention.

As shown in FIG. 4A, the lifting portion 232' of the upper panel 23' is extended directly from the flat opening portion 231' in an inclined manner to form a slant indented area 232-1'. FIG. 4B illustrates another alternative mode of the present invention, wherein the opening portion 231" is made to form an inclined flat surface and the lifting portion 232" is made to form an indenting flat surface directly extended horizontally from the opening portion 231".

Figure 5:
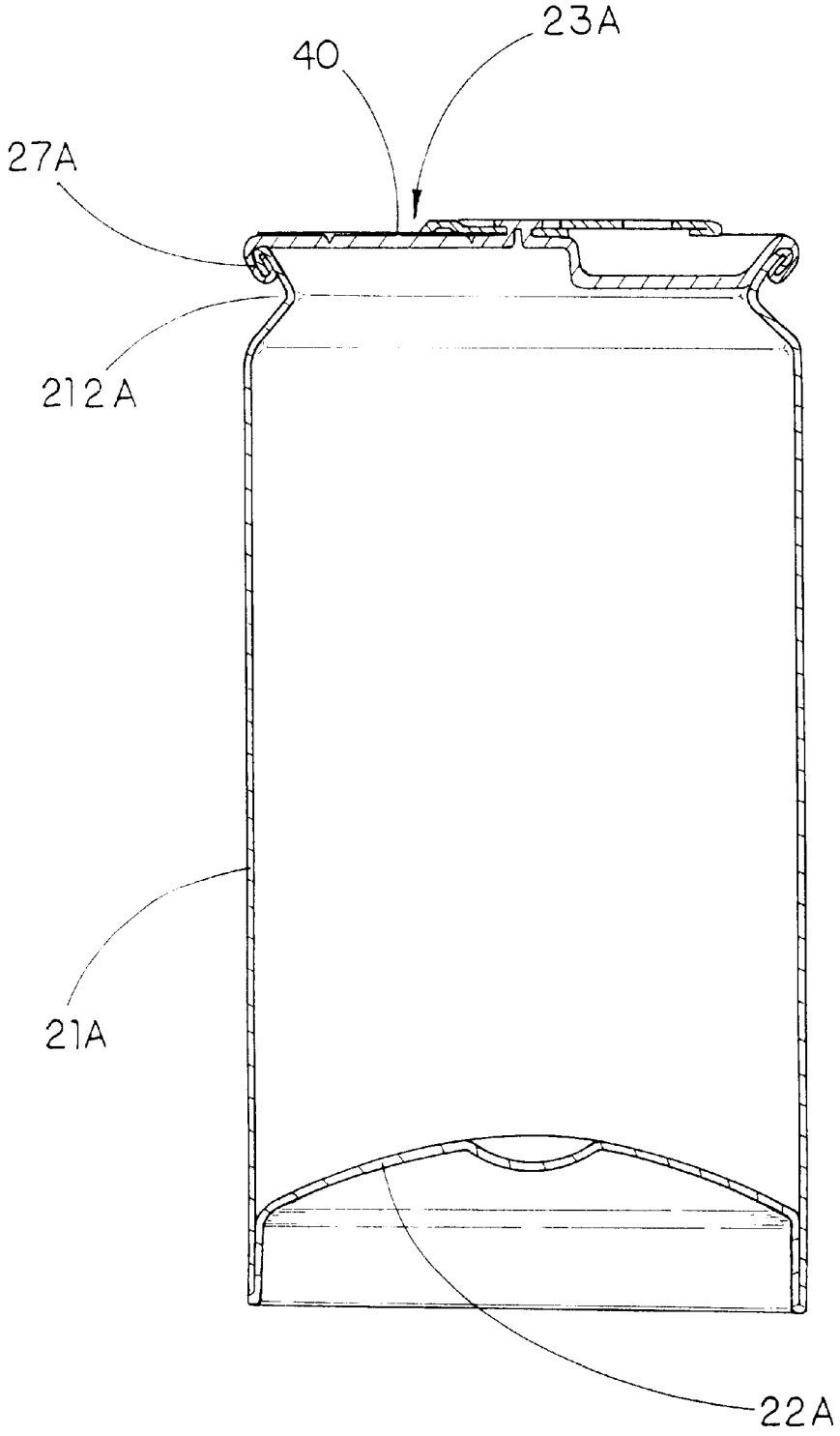
FIG. 5 is a sectional view of a third alternative mode of the beverage container according to the above preferred embodiment of the present invention.

As shown in FIG. 5, a third alternative mode of the above preferred embodiment of the present invention which basically has an identical structure to the above embodiment is illustrated, wherein the upper panel 23*a* is made as an independent piece while the can body 21*a* and the bottom panel 22*a* are made integrally to form a single body. The peripheral edge of the upper panel 23*a* is sealedly connected with the edge of the top end 212*a* of the can body 21*a* to form a surrounding rim 27*a*.

Figure 6:
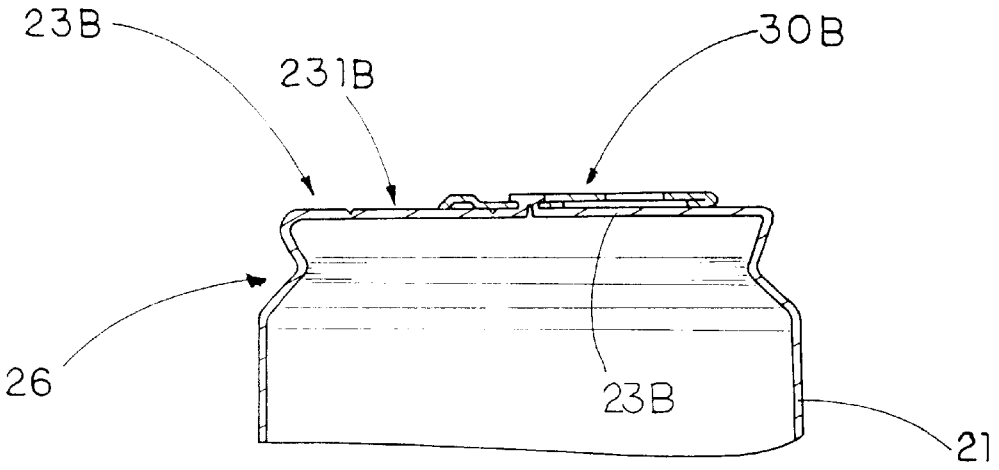
FIG. 6 is a sectional view of a fourth alternative mode of the beverage container according to the above preferred embodiment of the present invention.

As shown in FIG. 6, a fourth alternative mode of the above preferred embodiment of the present invention, wherein even the indented area 232-1 is eliminated. The entire upper panel 23*b* provides a flat top surface with the opening device 30*b* mounted thereon directly. The ring groove 26 is preferred to form around the top end of the can body 21 right below the peripheral edge of the upper panel 23*b* for reinforcing the flat upper panel 23*b*. Certainly, it is not as good as the above preferred embodiment but it can still provide an easy cleaning opening portion 231*b*. Therefore, it should also be considered as a possible alternative modification of the present invention.

Figure 7:
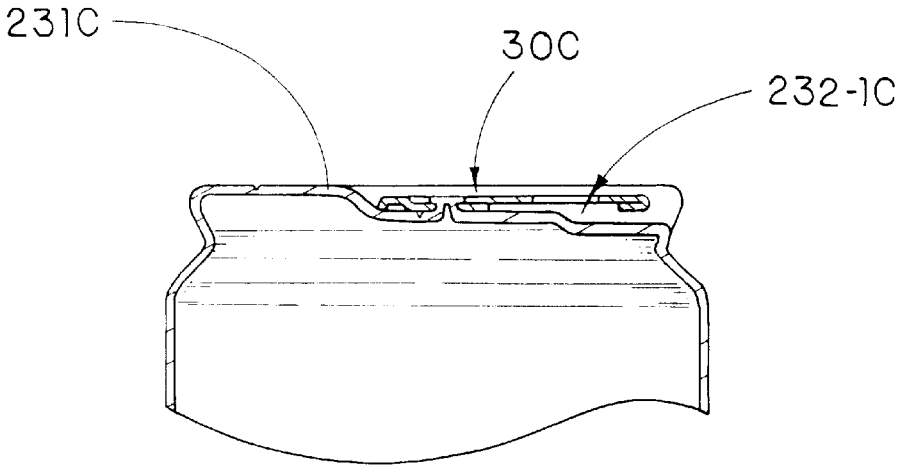
FIG. 7 is a sectional view of a fifth alternative mode of the beverage container according to the above preferred embodiment of the present invention.

As shown in FIG. 7, a fifth alternative mode of the above preferred embodiment of the present invention, which also has a flat opening portion 231*c* while the indented area 232-1*c* is a groove shaped to merely receive the opening device 30*c* therein. It can work as good as the above preferred embodiment.

What is claimed is:

1. A beverage container, comprising:

tubular can body;

a concave bottom panel integrally formed at a bottom end of said can body;

an upper panel integrally formed at a top end of said can body having a peripheral edge which is divided into a first segment and a second segment, wherein said upper panel is divided into an opening portion surrounded by a side edge thereof and said first segment of said peripheral edge and a lifting portion surrounded by said side edge of said opening portion and said second segment of said peripheral edge of said upper panel, wherein said first segment of said peripheral edge is flatly extended to said side edge to define a flat surface, and said lifting portion provides an indented area extending from said side edge of said opening portion to said second segment of said peripheral edge of said upper panel, and that a ring-shaped precut breaking line is formed around a valve member provided on said flat surface; and an opening device comprising a lifting ring, a pressing portion integrally formed with said lifting ring, an affixing portion formed between said lifting ring and said pressing portion, and a fixing member affixing said affixing portion to said upper panel, wherein said fixing member is affixed adjacent to said side edge of said opening portion, and that said lifting ring is extended above said lifting portion of said upper panel while said pressing portion is extended on said opening portion to define a gap between said lifting ring and said lifting portion of said upper panel, wherein when said pressing portion of said opening device presses on said opening portion of said upper panel by lifting up said lifting ring, said valve member is opened and an opening is formed along said precut breaking line.

2. A beverage container, as recited in claim 1, wherein said lifting portion is arranged lower than said flat surface of said opening portion to define said indented area which is indented and extended within a boundary defined by said side edge and said second segment of said peripheral edge of said upper panel, and that said side edge and said second segment of said peripheral edge form a semi-circular rim surrounding said indented area for reinforcing said upper panel to prevent deformation by unexpected impact or pressure, wherein a ring groove is formed around said top end of said can body right below said first and second segments of said peripheral edge of said upper panel, wherein said ring groove with respect to said opening portion of said upper panel renders said first segment of said peripheral edge to have a V-shape cross section, and that with respect to said ring groove, said second segment of said peripheral edge forms an overlapped rim.

3. A beverage container, as recited in claim 1, wherein said opening portion is made to form an inclined flat surface and said lifting portion is made to form an indenting flat surface directly extended horizontally from said opening portion.

4. A beverage container, as recited in claim 3, wherein said flat surface of said opening portion of said upper panel is detachably attached with a protective film to cover said valve member.

5. A beverage container, as recited in claim 1, wherein a ring groove is formed around said top end of said can body right below said first and second segments of said peripheral edge of said upper panel, wherein said ring groove with respect to said opening portion of said upper panel renders said first segment of said peripheral edge to have a V-shape cross section, and that with respect to said ring groove, said second segment of said peripheral edge forms an overlapped rim.

6. A beverage container, as recited in claim 5, wherein said lifting portion of said upper panel is extended directly from said flat opening portion in an inclined manner to form a slant indented area.

7. A beverage container, as recited in claim 5, wherein said upper panel is made as an independent piece while said can body and said bottom panel are made integrally to form a single body, said first and second segments of said peripheral edge of said upper panel are sealably connected with an edge of said top end of said can body to form a surrounding rim.

8. A beverage container, as recited in claim 5, wherein said flat surface of said opening portion of said upper panel is detachably attached with a protective film to cover said valve member.

9. A beverage container, as recited in claim 1, wherein said lifting portion is arranged lower than said flat surface of said opening portion to define said indented area which is indented and extended within a boundary defined by said side edge and said second segment of said peripheral edge of said upper panel, and that said side edge and said second segment of said peripheral edge form a semi-circular rim surrounding said indented area for reinforcing said upper panel to prevent deformation by unexpected impact or pressure, wherein said side edge of said opening portion and said second segment of said peripheral edge are inclined edges, and said side edge substantially reinforces said affixing portion of said opening device to prevent deformation of said opening portion while lifting said lifting ring to press down said pressing portion of said opening device, wherein a ring groove is formed around said top end of said can body right below said first and second segments of said peripheral edge of said upper panel, wherein said ring groove with respect to said opening portion of said upper panel renders said first segment of said peripheral edge to have a V-shape cross section, and that with respect to said ring groove, said second segment of said peripheral edge forms an overlapped rim.

10. A beverage container, as recited in claim 9, wherein said flat surface of said opening portion of said upper panel is detachably attached with a protective film to cover said valve member.

11. A beverage container, as recited in claim 9, wherein said upper panel and said can body are made from a single piece of material, and said bottom panel is formed from another piece of material and sealably connected to said bottom end of said can body to form a reinforcing peripheral rim.

12. A beverage container, as recited in claim 11, wherein said flat surface of said opening portion of said upper panel is detachably attached with a protective film to cover said valve member.

13. A beverage container, as recited in claim 11, wherein said upper panel has a diameter smaller than said bottom panel.

14. A beverage container, as recited in claim 13, wherein said lifting portion of said upper panel is extended directly from said flat opening portion in an inclined manner to form a slant indented area.

15. A beverage container, as recited in claim 14, wherein said flat surface of said opening portion of said upper panel is detachably attached with a protective film to cover said valve member.

16. A beverage container, comprising:

a tubular can body;

a concave bottom panel integrally formed at a bottom end of said can body;

an upper panel integrally formed at a top end of said can body, said upper panel has a peripheral edge and a flat top surface extended within a boundary defined by said peripheral edge, and a ring-shaped precut breaking line is formed around a valve member provided on said flat top surface, wherein a ring groove is formed around said top end of said can body right below said peripheral edge of said upper panel for reinforcing said flat top surface of said upper panel; and an opening device comprising a lifting ring, a pressing portion integrally formed with said lifting ring, an affixing portion formed between said lifting ring and said pressing portion, and a fixing member affixing said affixing portion to said upper panel, wherein said fixing member is affixed on said flat top surface, wherein a gap is defined between said lifting ring and said flat top surface of said upper panel, wherein when said pressing portion of said opening device presses on said upper panel by lifting up said lifting ring, said valve member is opened and an opening is formed along said precut breaking line.

17. A beverage container, comprising:

a tubular can body;

a concave bottom panel integrally formed at a bottom end of said can body;

an upper panel integrally formed at a top end of said can body having a peripheral edge which is divided into a first segment and a second segment, said upper panel being divided into an opening portion and a lifting portion, wherein said opening portion is a flat surface extending from said first segment of said peripheral edge to said lifting portion, and said lifting portion provides an indented area extending from said opening portion to said second segment of said peripheral edge, and that a ring-shaped precut breaking line is formed around a valve member provided on said flat surface; and an opening device comprising a lifting ring, a pressing portion integrally formed with said lifting ring, an affixing portion formed between said lifting ring and said pressing portion, and a fixing member affixing said affixing portion to said upper panel, wherein said fixing member is affixed on said lifting portion, and that said lifting ring is extended above said lifting portion of said upper panel while said pressing portion is extended on said flat surface of said opening portion to define a gap between said lifting ring and said lifting portion of said upper panel, wherein when said pressing portion of said opening device presses on said opening portion of said upper panel by lifting up said lifting ring, said valve member is opened and an opening is formed along said precut breaking line, wherein said indented area of said lifting portion of said upper panel is provided in groove shaped to merely receive said opening device therein.

* * * * *